United States Patent [19]

Buckner

[11] 4,260,088

[45] Apr. 7, 1981

[54] SHOULDER-SUPPORTED GOLF CLUB CARRIER

[76] Inventor: William L. Buckner, P.O. Box 1041, Sanford, N.C. 27330

[21] Appl. No.: 162,753

[22] Filed: Jun. 25, 1980

[51] Int. Cl.[3] ..... A45C 11/38

[52] U.S. Cl. ..... 224/202; 224/149; 150/1.5 R

[58] Field of Search ..... 224/202, 45 E, 45 N, 224/46 R, 49, 58, 205, 206, 250, 257, 258; 150/1.5 R

[56] References Cited

U.S. PATENT DOCUMENTS

| | | | |
|---|---|---|---|
| 511,690 | 12/1893 | Edwards | 224/46 R |
| 1,563,816 | 12/1925 | Worthington | 150/1.5 R |
| 2,485,864 | 10/1949 | Cohen et al. | 224/49 |
| 2,486,827 | 11/1949 | Duncan | 224/49 |
| 2,982,455 | 5/1961 | Rosen | 224/46 R X |
| 2,987,109 | 6/1961 | Sohmer | 224/46 R |

*Primary Examiner*—Steven M. Pollard

[57] ABSTRACT

A shoulder-supported golf club carrier formed from a single flexible strap curved to engage the shoulder of the user, the ends of the strap containing endless loops allowing the adjacent portions of the strap to extend loosely through the loops to form free running nooses in which golf club shafts are releasably securable. A stabilizing member is fixedly secured to the strap a fixed distance from each end of the strap. Self-releasing means in the form of elastic bands are connected to the loops and the strap so that the bands urge the strap through the loops to loosen the nooses when the weight of the carried clubs is removed.

4 Claims, 6 Drawing Figures

SHOULDER-SUPPORTED GOLF CLUB CARRIER

BACKGROUND OF THE INVENTION

This invention relates to a shoulder-supported golf club carrier and more particularly to means for lightening the combined weight of the clubs and the carrier to conserve the strength and energy of the player and to hold the golf clubs in a manner that will permit easy removal of any club from the carrier as desired.

It is common practice for golf players to utilize electric or gasoline golf carts or to employ caddies to carry their golf bags with golf clubs. There is a trend today however toward more exercise, and many golfers now prefer to carry their own clubs and walk through the round of golf to obtain maximum health benefits. It is also true that many golfers like to play less than a full round of golf either before or after work or at times when there is insufficient time to play a full round. Under those circumstances, many golfers carry a lightweight bag and less than full set of clubs because they play fewer and perhaps selected holes of golf during these abbreviated periods. It is also true that many golfers prefer to carry their own clubs and walk through a round of golf because of the expenses related to renting golf carts and employing caddies.

SUMMARY OF THE INVENTION

The present invention is a shoulder-supported golf club carrier formed from a flexible strap curved to engage the shoulder of the user. A stabilizing member is fixedly secured to the strap a predetermined distance from each end of the strap, and each end of the strap contains an endless loop. Strap portions adjacent the stablizing member extend loosely through the loops to form free running nooses to hold the shafts of golf clubs in a secure but easily releasable manner. A flexible container is fixedly but movably secured to the stablizing member to hold golf balls, tees, cleat wrenches and other necessary accessories.

The invention also includes a self-releasing feature whereby elastic bands are connected to each of the loops and to the strap so that the bands urge the strap through the loops to loosen the nooses when the weight of the carried clubs is neutralized or removed either by placing the carrier on the ground or lifting the weight of the clubs by hand while the carrier is being worn.

Accordingly, one object of the present invention is to provide a novel and improved shoulder-supported golf club carrier that will weigh only a fraction of the weight of more conventional golf club bags and holding devices and which is simple in design and inexpensive to manufacture.

Another object of the present invention is to provide a novel and improved shoulder-supported golf club carrier having self-releasing means so that the nooses engaging the clubs will automatically open to free the clubs when the weight of the carried clubs is neutralized.

Other objects and advantages of the present invention will be apparent to and understood by those skilled in the art from the following detailed description in the drawings.

BRIEF DESCRIPTION OF THE DRAWINGS

Referring now to the drawings, wherein like characters of reference designate a like part throughout the several views.

DESCRIPTION OF THE PREFERRED EMBODIMENT

Figure 1:
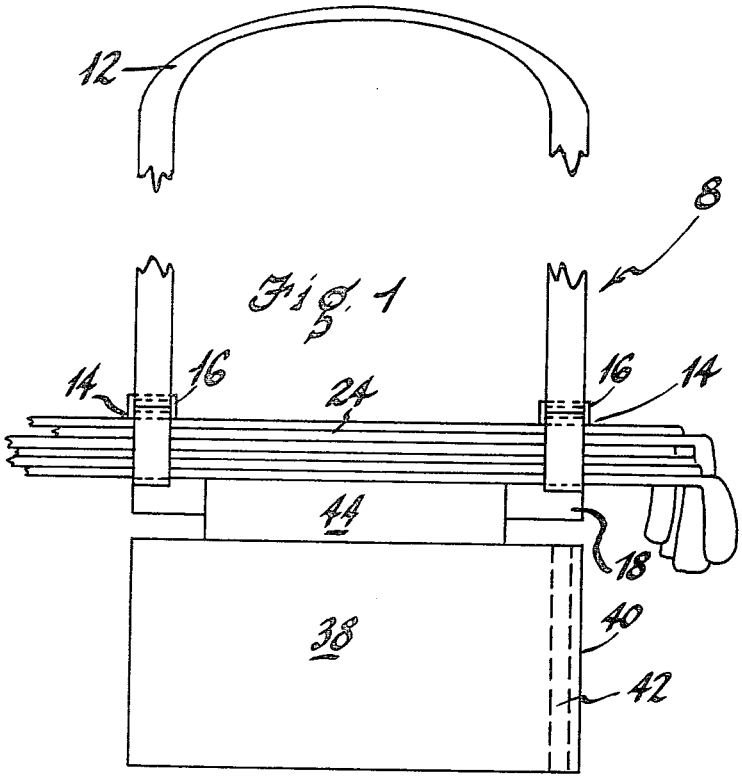
FIG. 1 is a perspective view of the shoulder-supported golf club carrier comprising the present invention showing a plurality of golf clubs being held within the nooses formed by the flexible strap.
Figure 2:
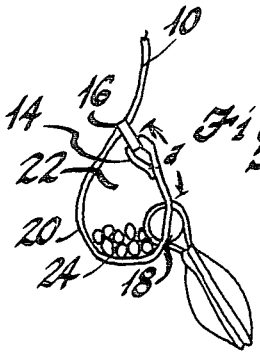
FIG. 2 is a side elevational and fragmentary view of the present invention showing one noose in a loosened relationship about a plurality of golf club shafts.

Referring now to the drawings and particularly to FIG. 1, the shoulder-supported golf club carrier comprising the present invention is shown generally as 8 and is principally formed by a flexible strap 10 curved to form a shoulder-engaging portion 12, the ends 14 of which are affixed to endless loops 16.

A stabilizing member 18 is fixedly secured to strap 10 a predetermined distance from each end of strap 10. The strap portions 20 adjacent the stabilizing member 18 extend loosely through the loops 16 to form free-running nooses 22 in which golf club shafts 24 are releasibly secured.

The stabilizing member 18 has sufficient mass and density to neutralize the collective weight of the club heads so as to counterbalance any tendency of the collective heads of the clubs to twist or turn the carrier on the shoulder of the wearer. Moreover, the stabilizing member 18 is slotted to fixedly receive and retain the strap 10 to provide overall strength and stability to the carrier in a simple and reliable assembly.

Figure 4:
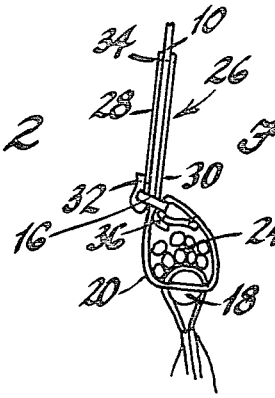
FIG. 4 is a side elevational and fragmentary view of the present invention including the self-releasing elastic bands connected to the loops and the flexible strap with the formed noose tightened about a plurality of golf club shafts.
Figure 3:
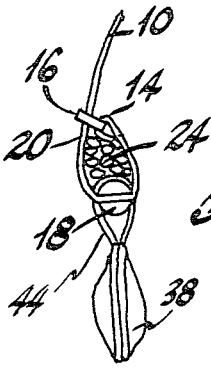
FIG. 3 is a side elevational and fragmentary view of the present invention showing one noose tightened about a plurality of golf club shafts.
Figure 5:
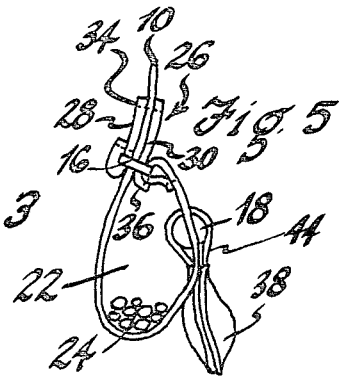
FIG. 5 is a side elevational and fragmentary view of the present invention showing the self-tightening elastic bands acting to loosen the noose formed by the strap and the endless loop.
Figure 6:
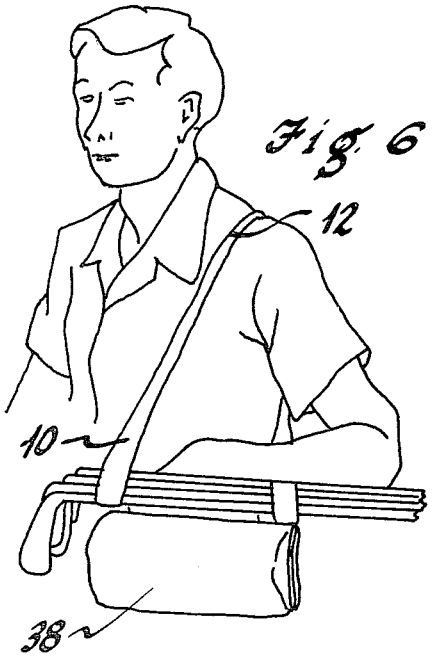
FIG. 6 is a perspective view of the golf club carrier comprising the present invention shown supported from the shoulder of the player and having a number of clubs inserted in the formed nooses to enable the clubs to be selectively withdrawn therefrom.

The carrier comprising the present invention may also be equipped with a self-releasing assembly shown generally as 26 in FIGS. 4 and 5 which includes elastic bands 28 and 30 connected broadly to loops 16 and strap 10. Elastic band 28, for example, encircles loop 16 and connects to itself at junction 32. It also connects to strap 10 at junction 34.

Elastic band 30 connects indirectly to loop 16 by joining that portion of strap 10 that connects to loop 16 at junction 36. The other end of band 30 joins strap 10 at junction 34.

When the weight of the carried clubs is exerted against the nooses 22, the nooses tighten about the shafts of the clubs as shown in FIG. 4 thus elongating elastic bands 28 and 30. When the weight of the clubs is removed by, for example, placing the carrier on the ground or lifting the clubs by hand, elastic bands 28 and 30 contract to loosen the noose 22 as shown in FIG. 5 thus enabling easy removal of the clubs from the carrier.

The carrier includes a flexible accessory container 38 having an open end 40 releasably closable by internally secured strips of velcro 42 or other suitable means. The carrier container 38 is movably secured to stabilizing member 18 by a segment of pliable material 44 looped about member 18 with both ends fastened to the upper edge of container 38.

From the foregoing description, it can be seen that a simple, durable, reliable, and inexpensive shoulder-supported golf club carrier has been presented. While a preferred embodiment has been shown and described, various modifications and substitutions can be made thereto without departing from the spirit and scope of the invention. Accordingly, it is to be understood that the present invention has been described by way of illustration only and not limitation.

What is claimed is:

1. A shoulder-supported golf club carrier comprising: a flexible strap curved to form a shoulder-engaging portion; a stabilizing member fixedly secured to said strap a predetermined distance from each end of said strap; an endless loop affixed to each end of said strap, the strap portions adjacent said stabilizing member extending loosely through said loops to form free-running nooses in which golf club shafts are releasably securable; and a flexible accessory container movably secured to said stabilizing member.

2. The carrier as claimed in claim 1 further comprising self-releasing means loosing said nooses when the force tending to tighten the nooses is neutralized.

3. The carrier as claimed in claim 2 wherein said self-releasing means includes elastic bands connected to said loops and said strap in a direction toward said shoulder-engaging portion.

4. The carrier as claimed in claim 3 wherein said elastic bands include at least two elastic bands securable to each of said loops and said strap whereby the bands urge the strap through the loops to loosen the nooses when the weight of the carried clubs is neutralized.

* * * * *